United States Patent [19]

Robertshaw

[11] Patent Number: 4,471,498

[45] Date of Patent: Sep. 18, 1984

[54] FLUSH CONTROL

[75] Inventor: Derek Robertshaw, Bradford, England

[73] Assignee: Laycock Bros. Limited, Bradford, England

[21] Appl. No.: 338,156

[22] Filed: Jan. 8, 1982

[30] Foreign Application Priority Data

Jan. 10, 1981 [GB] United Kingdom ..... 8100707

[51] Int. Cl.[3] ..... E03D 13/00

[52] U.S. Cl. ..... 4/302; 4/305; 4/406; 4/DIG. 3

[58] Field of Search ..... 4/302, 406, 303, 304, 4/305, DIG. 3

[56] References Cited

U.S. PATENT DOCUMENTS

| | | | |
|---|---|---|---|
| 2,603,794 | 7/1952 | Boksen | 4/304 |
| 3,193,846 | 7/1965 | Lefebrre | 4/305 |
| 3,371,353 | 3/1968 | Filling | 4/305 |
| 3,416,162 | 12/1968 | Hamblon | 4/305 |
| 3,575,640 | 4/1971 | Ishikawa | 4/304 |
| 3,863,196 | 1/1975 | Hilles | 4/304 X |
| 4,134,163 | 1/1979 | Matsunaga | 4/302 |
| 4,196,481 | 4/1980 | Swanda | 4/305 |
| 4,309,781 | 1/1982 | Lissau | 4/305 X |

*Primary Examiner*—Henry K. Artis

*Attorney, Agent, or Firm*—Norbert P. Holler; Charles A. Blank

[57] ABSTRACT

Apparatus for controlling the flushing of a lavatory, for example in a mens urinal, comprises a source of water for flushing, a flush control valve SV wherein the valve is actuated in response to the usage of the lavatory, for example by means of door switch DS. In order that over-use of the device should be prevented in busy periods, a delay circuit D1 is provided to prevent a second actuation of the water supply solenoid valve within a preset period from a first actuation.

5 Claims, 3 Drawing Figures

FLUSH CONTROL

This invention relates to an apparatus for controlling the automatic flushing of water closets, urinals, and the like.

In public conveniences or communal lavatories, in particular for the urinals provided in men's toilets, provision is often made for regular automatic flushing of the toilets to occur. An arrangement commonly used in connection with urinals comprises a tank or system which fills up slowly with water and, the water having reached a predetermined level, is discharged into the urinal thereby flushing it. The system then begins to fill up again so repeating the cycle. Such an arrangement provides regular flushing on a continuous, round-the-clock basis. However, many communal lavatories are only used during part of the day, for example during office hours or, in connection with licenced premises, during licenced hours. Consequently, currently available automatic systems necessarily involve considerable wastage of water. With rising charges of water usage, such wastage is becoming increasingly expensive.

The invention seeks to provide an apparatus for controlling the flushing of automatically flushed lavatories which reduces the wastage of water inherent with currently available automatic flushing systems.

In its broadest aspect, the present invention provides an apparatus for controlling the flushing of a lavatory which comprises a source of water for flushing, a flush control valve, the valve being actuated in response to usage of the lavatory, and a delay circuit to prevent over use in busy periods.

The valve may be an electrically actuated solenoid valve and the actuation may be provided by an electrical signal caused, for example, by a switch triggered by opening of the lavatory door, a photocell and light beam arrangement across the entrance to the lavatory, sonic beam, pressure pad, or other suitable means. Thus, in this aspect, the flushing of the lavatory is actuated by the entry of persons using it.

In order to prevent over-flushing in busy periods, a delay circuit is built into the valve actuation means. Thus, a delay of, say, several minutes may be programmed into the circuit such that a flush will not be actuated more often than once in each delay period.

Furthermore, in order to ensure the correct amount of water for flushing the lavatory adequately, a period during which the flush control valve is opened is preferably programmable into the circuit of the apparatus. This period will vary with the water pressure, diameter of the pipes, and so forth but is simply determined empirically in any given case. A typical variation would be between 0 and 5 minutes. The flush control valve, once actuated, should remain open to ensure an adequate flush, but no longer, so as to reduce wastage.

Where the apparatus according to the invention is fitted to existing systems already having a storage tank or cystern for flushing water, then the control valve may be arranged so as to cause the existing cystern to empty when the valve is actuated; however, when the apparatus of the invention is fitted ab initio to new systems, it is envisaged that the storage tank or cystern may be dispensed with completely, a flush control valve being fitted directly into the mains water supply, where local regulations allow it. In the latter case, the capital expense of fitting a system according to the invention is very much reduced owing to the savings made in the fitting of the conventional flush control system.

Where local regulations require it, an override circuit may be provided, which will ensure a certain minimum of flushes per hour irrespective of usage of the lavatories.

The invention will be described further, by way of example, with reference to the accompanying drawings, in which.

Figure 1:
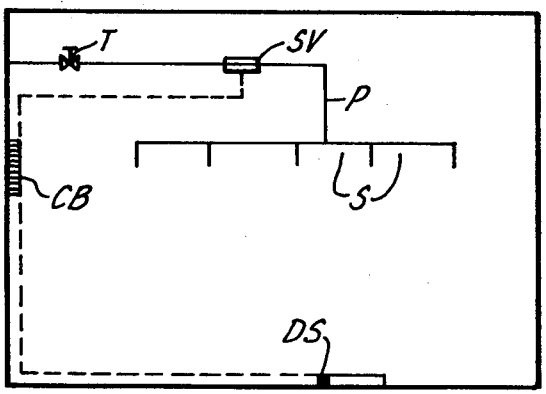
FIG. 1 is a diagram of a mens urinal fitted with an apparatus according to the invention.

Referring to the drawings, there is shown a mens urinal having a number of stalls S fitted with conventional flush pipes P connected to the mains water supply via a master stop tap T and a solenoid valve S V. The solenoid valve S V forms the flush control valve of the apparatus of the invention, and is electrically connected into the circuit shown in FIG. 2.

Figure 2:
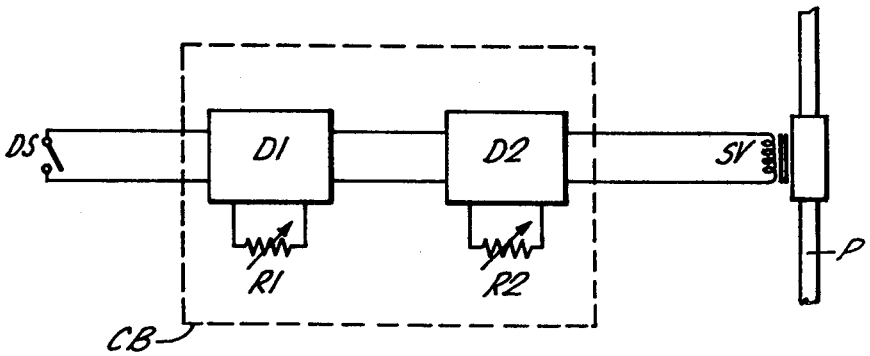
FIG. 2 is a block diagram of a suitable operating circuit.

Referring more particularly to FIG. 2, a master control box C B connected to an electrical mains supply and transformed down to a low voltage, e.g. 12 volts, for safety in operation, contains two delay circuits D1 and D2 each controllable within limits by their associated potentiometers R1 and R2 or switched resistors. A door switch D S, in this case a magnetic contact switch fitted to the hinge of the door is connected to the control box as is the actuation coil of the solenoid valve S V.

In use, the apparatus is installed and the power supply connected. The delay D1, which may be set by means of the potentiometer R1 to a delay period within the range of, for example, 20 to 60 minutes to accord with U.K. regulations, begins its delay period according to the time set. Once the set time has elapsed the delay D1 is energised. On a person entering the lavatory, the door switch D S is actuated thereby triggering the energised delay D1 to send a signal to the second delay D2. The delay time of the delay D2 can also be set within a period variable between, for instance 10 and 60 seconds, by means of the potentiometer R2. On receiving the signal from D1 the delay D2 energises the solenoid valve S V allowing water to flow in the pipe P. Having sent a signal to D2, the delay D1 is de-energised.

The delay D2 maintains the coil of the valve S V energised for its set delay period after which the delay D2 de-energises the valve S V shutting off the flow of water in the pipe P and delay D1 begins a new energising delay period.

During the period in which the delay D1 is reenergizing, in this case settable from between 20 and 60 minutes, further usage of the lavatory causing actuation of the door switch D S, will have no affect on the apparatus. However, once D1 is fully energised again the next usage will cause D2, and hence the solenoid valve S V, to be triggered once again. Delay D2 is set so that, having regard to the water pressure, and diameter of pipe, the desired amount of flush (for example one gallon per stall) is obtained.

It will be appreciated that, should long periods occur when the lavatory is not in use, no water will be used. Should this not be in accordance with local regulations, an additional circuit, for example containing a time clock, can be provided to override the circuit of FIG. 2 and provide a given minimum number of flushings in a set period so as to comply with regulations.

Solenoid valves suitable for use and has the flush control valve of the invention are commercially available, as are suitable door switches. For example, "Dewraswitch" type ASCO P8210C994HW has been found suitable for use as the flush control valve. A magnetic type of door switch, commonly available for use with for example burglar alarm systems, has also been found suitable for use in connection with the invention.

In a particular example, in a building used for eight hours per day, a two-stall urinal is fitted with a currently available automatic flush system which produces a flush of two gallons every ten minutes. Over twenty four hours this water usage is 288 gallons which represents 105,000 gallons per year. On installing an apparatus according to the invention, the maximum usage possible is 8/24 of this, that is 35,000 gallons per annum not taking into account weekends, holidays, or the like. Thus, in this example, the minimum saving is in the order of 70,000 gallons of water per annum which, at a coast of 0.001 p per gallon would produce a saving of £ 70.00 per annum, which would amortise the capital cost of installing the apparatus according to the invention between 1 and 2 years.

This degree of saving, taken nationally, would produce an annual saving of water roughly comparable with the contents of an entire reservoir.

The delay times set for D1 and D2 will of course vary according to local regulations and desired requirements, the times specified herein being in accordance with U.K. regulations which may well be different in other countries.

Figure 3:
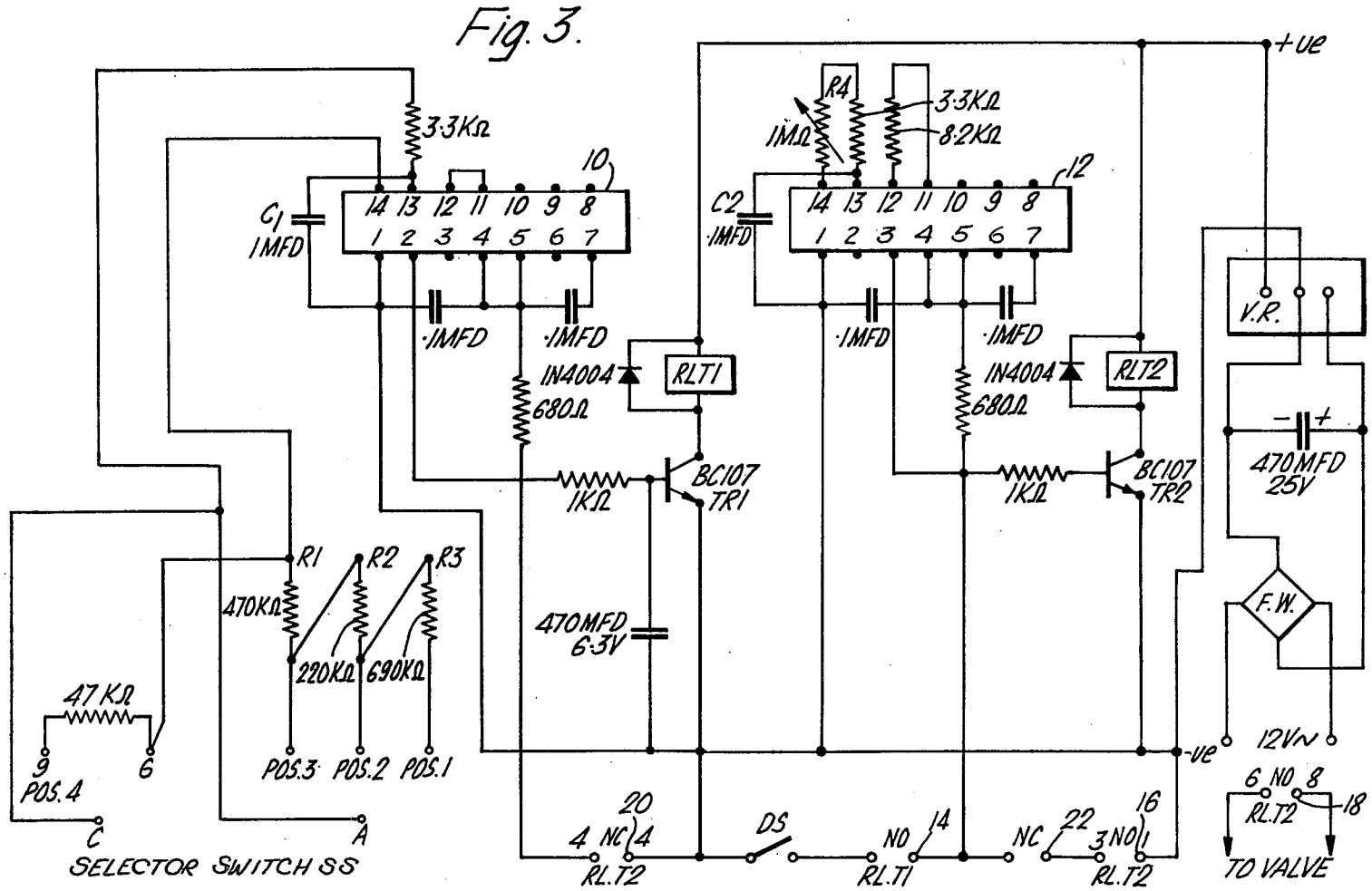
FIG. 3 is a circuit diagram of the operating circuit.

A particular form of circuit for the use with the present invention is illustrated in FIG. 3. This employs two commercially available integrated circuits used for timing purposes 10 and 12, corresponding to D1 and D2 respectively, in this case Ferranti Ser. No. ZN1034E timing chips. With these timing chips, when a potential is applied to terminal 5 it produces a potential at terminal 2 after a preset delay, or will switch off a potential from terminal 3 after the same preset delay. The preset delay data is controlled according to CR circuit connected to terminals 13 and 14 of the chips 10 and 12. With the timing unit 10 a selector switch is provided which will switch in the resistors R1, R2 and R3 in sequence. In this particular circuit R1 is chosen at 470 KΩ, corresponding to a time delay of 20 minutes, R2 is 220 KΩ which, together with R1 gives a time delay of 30 minutes and R3 is 680 KΩ which, together with R1 and R2 gives a time delay of 60 minutes. Once the set time delay has elapsed, a potential appears at terminal 2 which switches on the transistor TR1 and energises the coil of a first timing relay RLT1. The normally open contacts 14 of the relay RLT1 then close, and on the first activation of the door switch DS after this a potential is applied to the second timing unit 12, corresponding to the delay D2 in FIG. 2. This immediately causes the potential to appear at the terminal 3 of the timing unit 12, switching on transistor TR2 and energising the coil of the second relay RLT2. This causes normally open contacts 16 and 18 to close, and the normally closed contacts 20 to open. Contacts 18 are connected to the water control solenoid valve SV and allow water to flow through the system for the duration of the timing period set by the unit 12. The latter is set by the potentiometer R4 connected between terminals 14 and 13 of the unit 12, in combination with the capacitor C2. Once the timing delay set for the unit 12 has expired, the potential at terminal 3 is switched off and hence the relay RLT2 becomes de-energised. The contacts 20 then close again allowing the timing unit 10 to "time up" once more. While the latter is performing this process, further operation of the door switch DS will have no effect on the solenoid valve SV.

The units are supplied with a regulated voltage from a voltage regulator VR and a full wave rectifier FW connected to an alternating voltage supply.

A water level switch 22 may be provided connected in series with normally open terminal number 16 of the relay RLT2 for use when the solenoid valve SV is in the water supply to an existing cystern. The water level switch 22 can be set to cause the relay RLT2 to shut off ahead of its timed activation period should the water level exceed a preset limit in the cystern by the switch 22 being activated so as to open the circuit thereby causing the energising coil of the relay RLT2 to be de-activated.

Position 4 for the selector switch SS for the timing unit 10 puts a relatively low resistance, of 47 KΩ, in the timing circuit between the terminals 13 and 14. This produces a timing interval of approximately 144 seconds and is used for setting up the system initially.

I claim:

1. An apparatus for controlling the flushing of a lavatory which comprises a source of water for flushing, a flush control valve responsive to an electrical signal for actuation, means, including lavatory entrance detection means, for developing an electrical signal for actuating said control valve, a valve actuation delay circuit included in said valve actuating means and settable to actuate the valve for a period sufficient to ensure adequate flushing, and an over-use prevention delay circuit included in said valve actuating means, the latter delay circuit being actuated by the entrance detection means and serving to prevent actuation of the former delay circuit until the set delay time of the latter delay circuit has elapsed, and actuation of the former delay circuit serving to re-set the delay period of the over-use prevention delay circuit.

2. An apparatus as claimed in claim 1 in which the valve is an electrically actuated solenoid valve.

3. An apparatus as claimed in claim 1 in which the delay period of the over-use prevention delay circuit is from 5 minutes to 60 minutes.

4. An apparatus as claimed in claim 1 in which the delay period of the valve actuation delay circuit varies between 0 and 5 minutes.

5. An apparatus as claimed in claim 1 in which the delay circuits include integrated circuit timing chips and variable resistance circuits associated therewith settable for providing the delay periods.

* * * * *